US006381980B1

(12) United States Patent
Pringle

(10) Patent No.: US 6,381,980 B1
(45) Date of Patent: May 7, 2002

(54) PULSED-WATER CONDENSER COOLER

(76) Inventor: Robert D. Pringle, 154 E. 1287 Rd., Baldwin, KS (US) 66006

( * ) Notice: Subject to any disclaimer, the term of this patent is extended or adjusted under 35 U.S.C. 154(b) by 0 days.

(21) Appl. No.: 09/877,902

(22) Filed: Jun. 8, 2001

(51) Int. Cl.[7] ..... F28D 5/00; F25B 39/04
(52) U.S. Cl. ..... 62/305; 62/183
(58) Field of Search ..... 62/85, 171, 305; 137/625.43; 165/110, 285

(56) References Cited

U.S. PATENT DOCUMENTS

| | | | | | |
|---|---|---|---|---|---|
| 4,213,306 | A | * | 7/1980 | Peabody | 62/85 |
| 5,311,747 | A | | 5/1994 | Pringle | |
| 6,105,376 | A | * | 8/2000 | Stewart | 62/171 |
| 6,142,219 | A | * | 11/2000 | Korenic | 165/110 |
| 6,213,200 | B1 | * | 4/2001 | Carter | 165/285 |
| 6,234,207 | B1 | * | 5/2001 | Toyama | 137/625.43 |
| 6,253,565 | B1 | * | 7/2001 | Arledge | 62/305 |

* cited by examiner

*Primary Examiner*—William Doerrler
*Assistant Examiner*—Filip Zec
(74) *Attorney, Agent, or Firm*—Chase Law Firm, L.C.

(57) ABSTRACT

A sprinkler system for a condenser unit of an air conditioning system comprises a flue with a temperature responsive valve assembly releasably mounted therein. The flue is mounted atop the protective grill for the system fan so as to channel a portion of the fan's cooling air flow for the condenser therethrough. A bellows senses temperature changes within the flue and upon a selectable rise in temperature expands so as to urge the valve stem of a two-way poppet valve to a valve opening position. The open valve, connected to a water source, delivers water to an elongated fluid outlet line which is fastened along the grill surrounding the condenser unit. The elongated line comprises a plurality of segments connected by intermediate spray heads. The spray heads circumscribe the condenser with a cooling spray so as to reduce the temperature of the same. The valve is repeatedly cycled on and off by expansion of the bellows in response to a rise in condenser air flow temperature, and by contraction of the bellows response to the cooling effect of water from the outlet line returned to flow upon the bellows.

8 Claims, 9 Drawing Sheets

PULSED-WATER CONDENSER COOLER

BACKGROUND OF THE INVENTION

This invention relates to a cooling system for an air conditioning system, and more particularly, to a sprinkler system for discharging a pulsed water spray on a condenser unit or the like.

During extensive use of an air conditioning system, particularly during hot weather, the condenser unit of the system may become heated to the point that it decreases the system's efficiency and/or overheats to the point of failure. Accordingly, it is desirable to utilize a sprinkler system to cool the condenser unit so as to maintain its effectiveness and/or prevent overloading.

As shown and described in U.S. Pat. No. 5,311,747, it has been proposed to use a sprinkler system for cooling a condenser unit or the like which mounts a flue atop the condenser housing for channeling therethrough a portion of the air being passed across the condenser unit by a system fan. Within the flue is releasably mounted a valve assembly having a thermally responsive bellows for controlling a reciprocative movement of a valve stem of a two position poppet water valve. The bellows moves between contracted and expanded modes according to the sensed air flow temperature within the flue. This reciprocative motion of the valve stem closes and opens the valve to regulate a flow of fluid from an inlet line to an elongated outlet line. The outlet line is fastened to the grill surrounding the condenser unit and includes a plurality of tubular segments connected by spray nozzles protruding through the grill. This configuration surrounds the condenser unit with a water spray upon the bellows sensing a selectable elevated temperature. Although effective for reducing the temperature of the condenser and improving the operation of the associated air conditioning system, this system often discharges more water than can be evaporated on the condenser coils, thereby causing pooling on the ground around the perimeter of the condenser unit.

I desire to provide an improved condenser cooling system which uses less water, especially during moderately hot and/or humid weather, and which will not produce standing water at the condenser site. Unlike the system described above, the improved system of the present invention supplies water in shortened cycles (pulses) optimized for cooling the condenser coils with less water usage and waste.

SUMMARY OF THE INVENTION

In the present invention, the bellows moves between contracted and expanded modes in response to both the temperature of water returned and discharged upon the bellows, and the sensed air flow temperature within the flue. When the air temperature increases sufficiently to expand the bellows, thereby activating the delivery valve, water is released into the outlet line and discharged upon the condenser coil. A return line, either connected to or comprising a continuation of the outlet line, returns a portion of water not delivered through the nozzles back to the flue and discharges the water upon the bellows. The water cools the bellows in less time than air alone passing through the flue, resulting in faster shut-off of the water and thus minimization of excess flow. The resulting overall reduction in condenser temperature enhances the effective operation of the associated air conditioning system.

As ambient temperature rises, the cycle time during which the valve is open increases in duration and frequency. For example, at 90° F. the device may cycle on for two minutes and off for four minutes; at 95° F., on for two minutes and off for three minutes; and at 100° F., on for three minutes and off for two minutes. By providing water to the condenser coils in pulses, increasing in duration and/or frequency as the ambient temperature rises, the coils are kept wet to aid in cooling the unit without wasting excess water and causing unsightly spillage.

It is therefore a general object of this invention to provide a sprinkler system for cooling an air conditioning system or the like, which provides water in pulses in order to minimize the amount of water used by the system.

This object is accomplished by using a thermally responsive valve assembly for regulating the delivery of a cooling spray onto an air conditioning system; an outlet line under control of the valve assembly and which is provided with a plurality of flexible tubular segments connected by a plurality of spray nozzles; a means for sensing the temperature of a portion of the cooling air being passed over the condenser during system operation; and a return line from the outlet line for returning an unused portion of the delivered water and discharging the water onto the sensing means to limit the on time of the flow of water in the outlet line.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
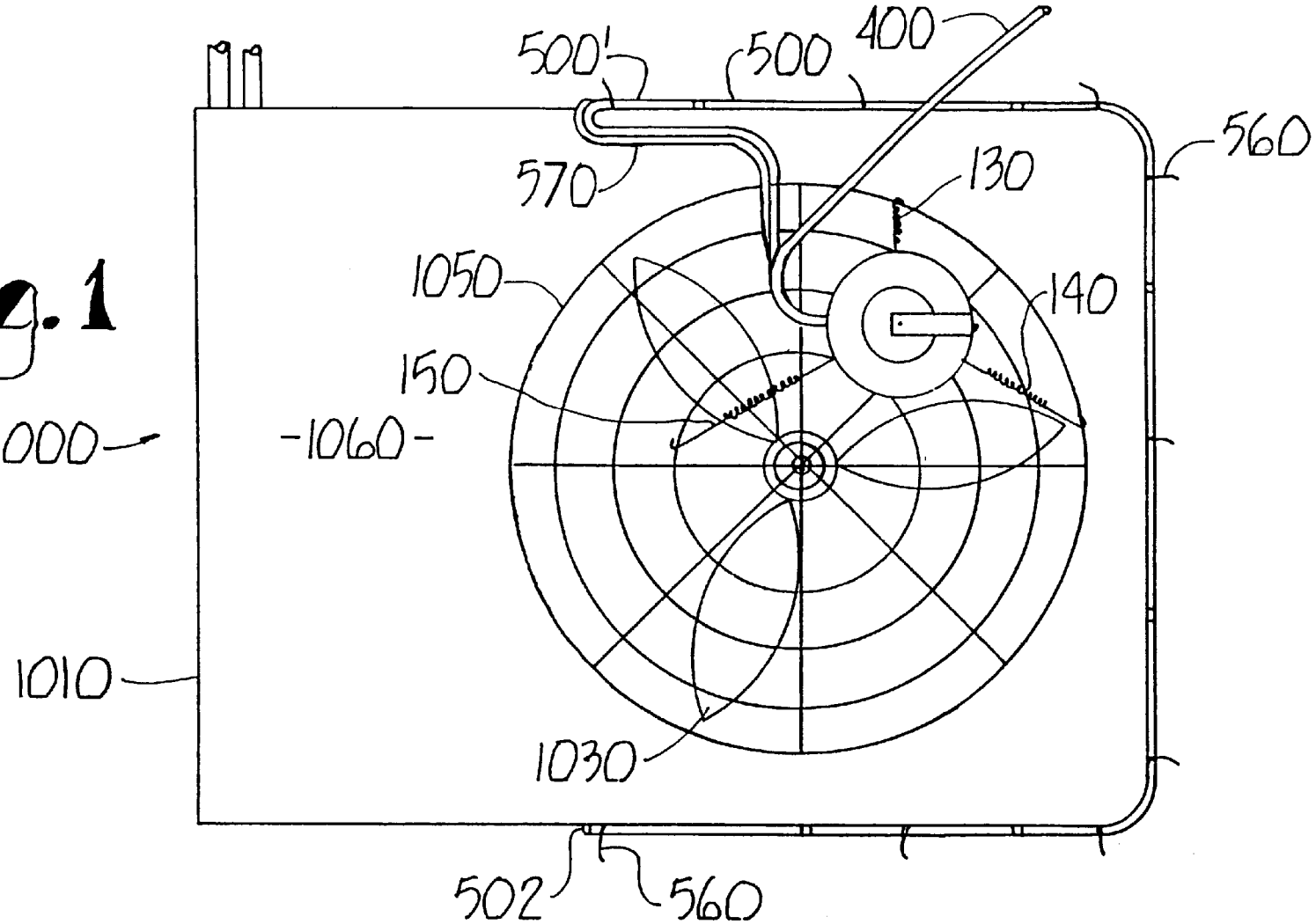
FIG. 1 is a top plan view of the housing about the condenser unit illustrating the attachment of the flue with valve assembly therein to the grill atop the condenser fan.

Turning more particularly to the drawings, FIG. 1 illustrates the outside unit 1000 of a conventional home air conditioning system. As shown the unit 1000 generally comprises a housing 1010 enclosing the condenser, compressor and fan 1030. A grill 1050, positioned in the top wall 1060 of the housing 1010, overlies the fan 1030 and a side grill 1100 surrounds the condenser unit. It is understood that the particular unit 1000 shown is for the purpose of illustration and not limitation.

Positioned atop the fan grill 1050 is a cylindrical flue 100 having upper 110 and lower 120 open ends. A plurality of tie down springs 130, 140, 150 are connected in tension at one end to the flue 100 with the lower end of each spring 130, 140, 150 being releasably attached to the fan grill 1050 by hooks 132 or the like. Upon such connection, the flue 100 is positioned atop the fan grill 1050. This abutting position allows for a portion of the cooling air flow, as drawn by the fan 1030 over the condenser, to be channeled through the flue 100.

Figure 2:
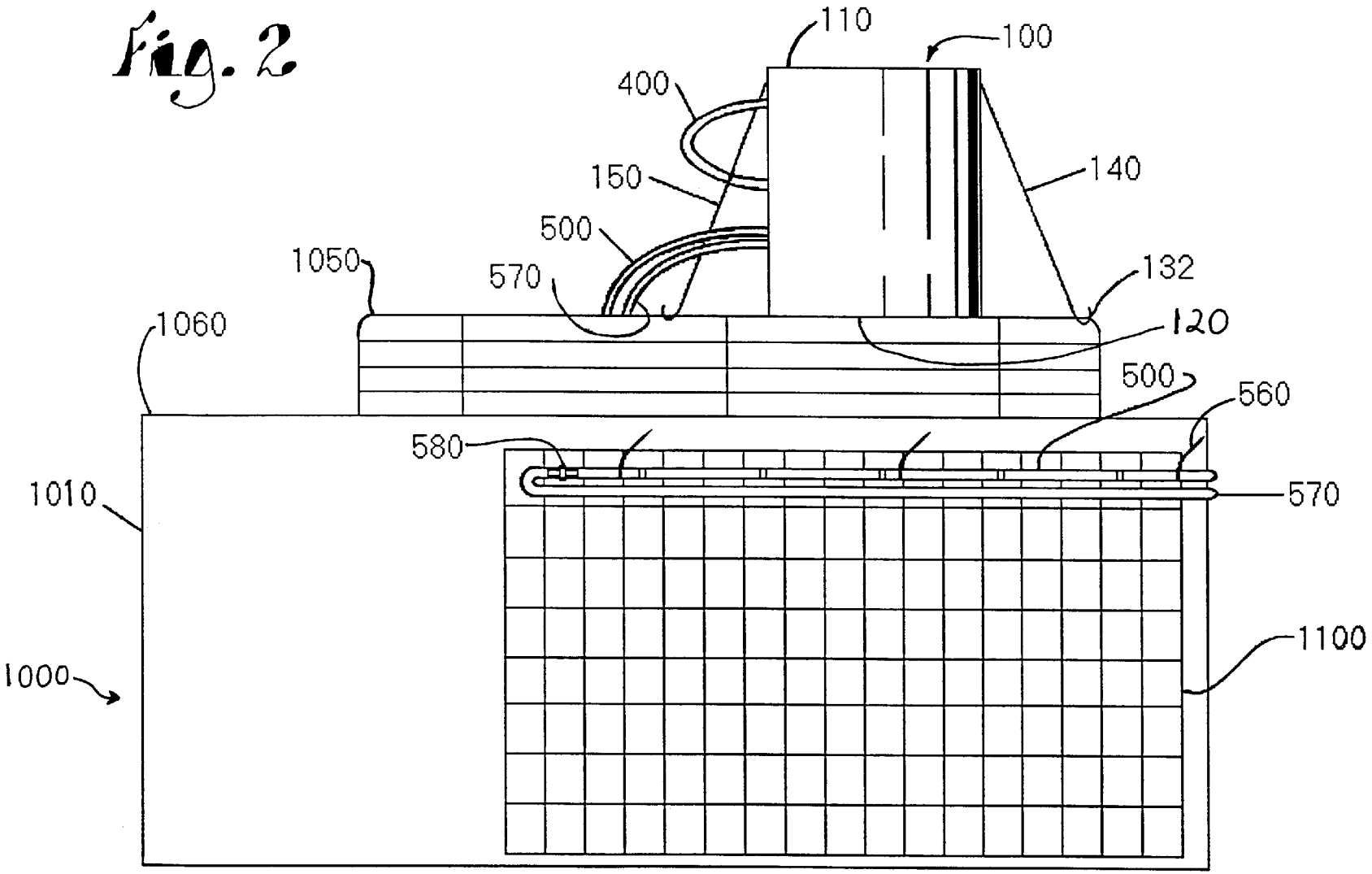
FIG. 2 is a side elevation view of the housing in FIG. 1 illustrating the attachment of the fluid outlet line to the grill about the condenser unit.
Figure 5:
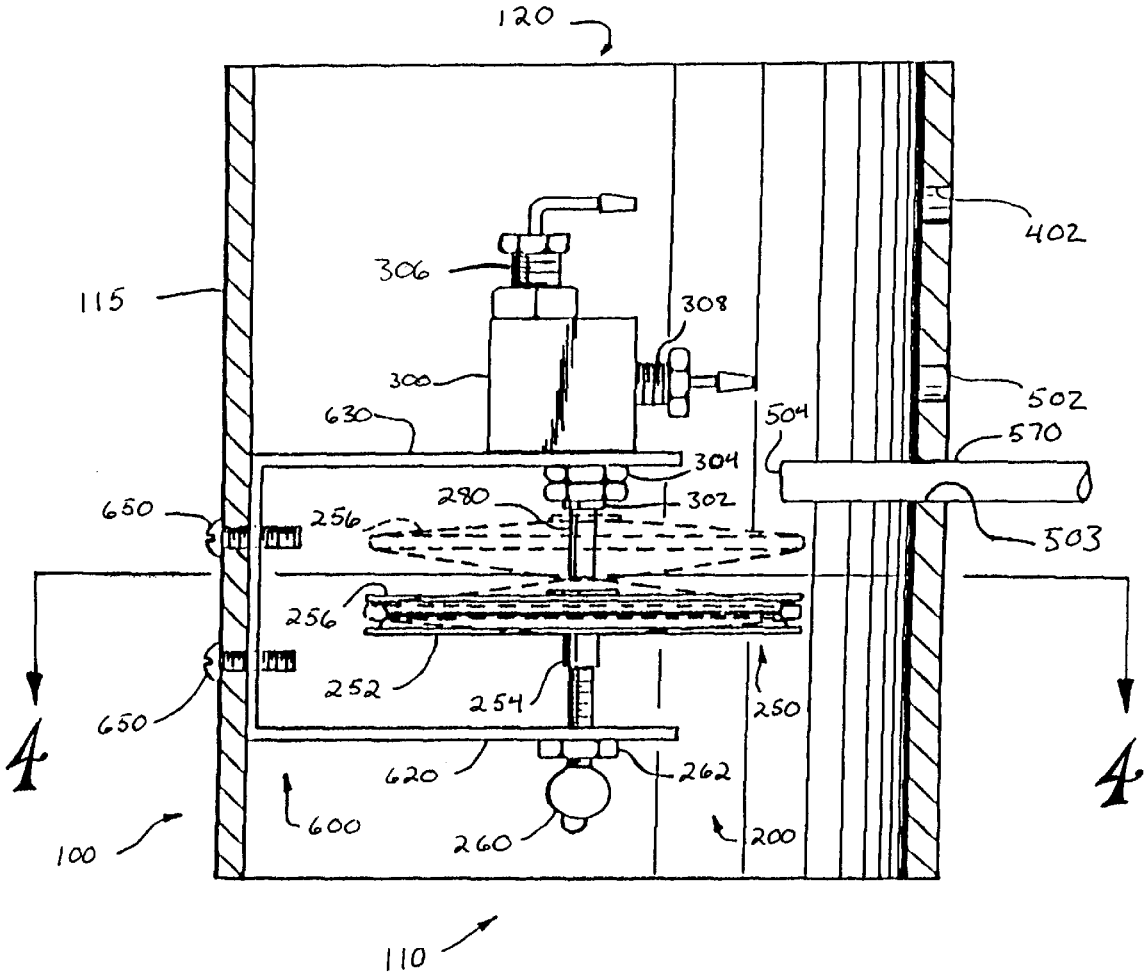
FIG. 5 is a vertical sectional view, on an enlarged scale, of the flue with a valve assembly therein and showing in phantom lines the expanded position of the thermally responsive bellows.

As best shown in FIG. 5, the flue 100 contains a valve assembly 200 for controlling the flow of a cooling fluid, e.g. water, between an inlet 400 and a condenser-surrounding outlet line 500 (FIG. 2). The valve assembly 200 generally comprises a thermally responsive expansion bellows 250 for controlling the direction of travel of a stem 280 of a two-way poppet valve 300. (One poppet valve used is a Clippard Minimatic MJV-2). The poppet valve 300 is normally closed when the stem 280 is in its biased, extended position as shown in FIG. 6.

The valve assembly 200 is mounted within the flue 100 by means of a U-shaped bracket 600 attached to a flue wall 115 by screws 650 or the like.

Figure 6:
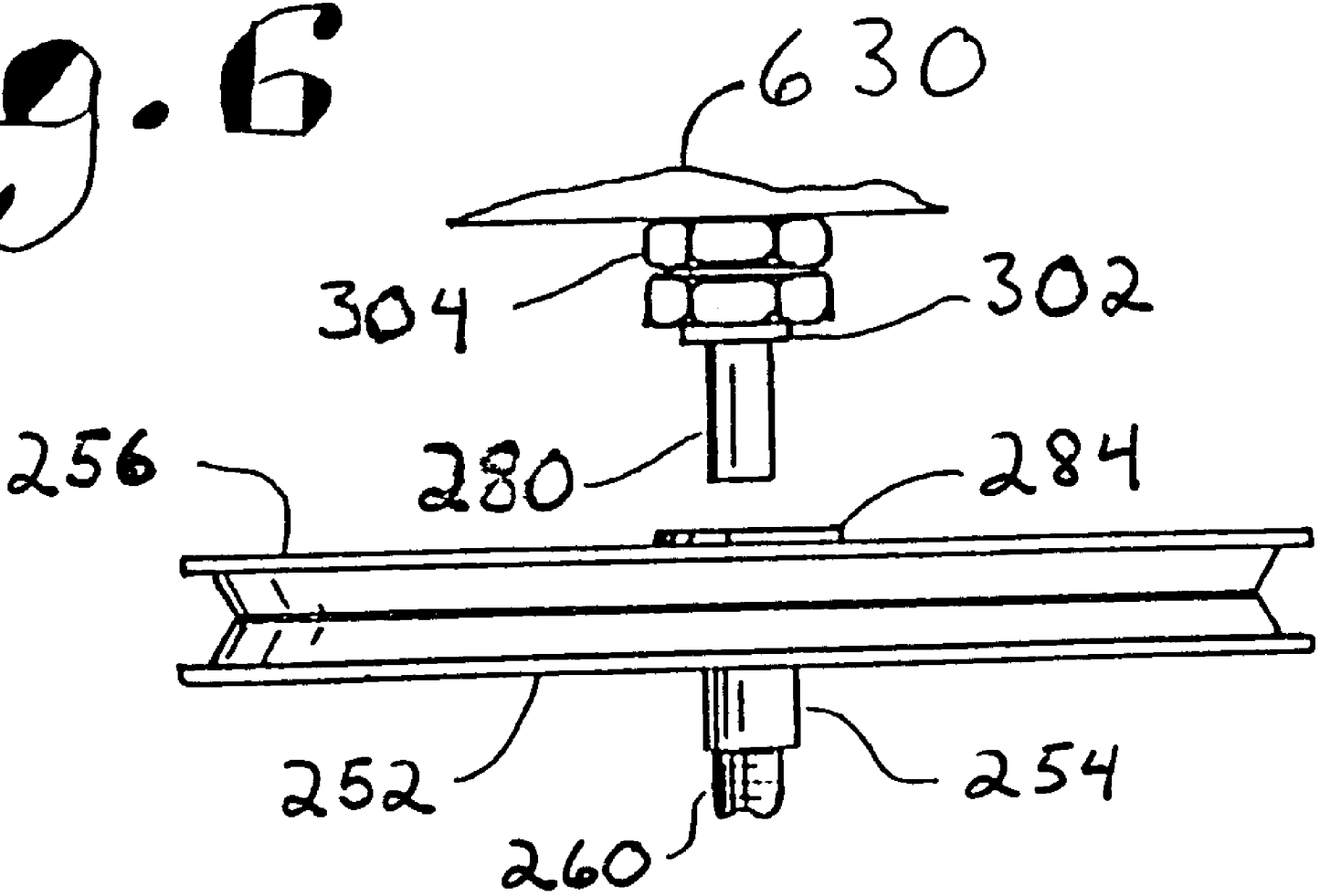
FIG. 6 is a diagrammatic view showing the contracted mode of the bellows.
Figure 7:
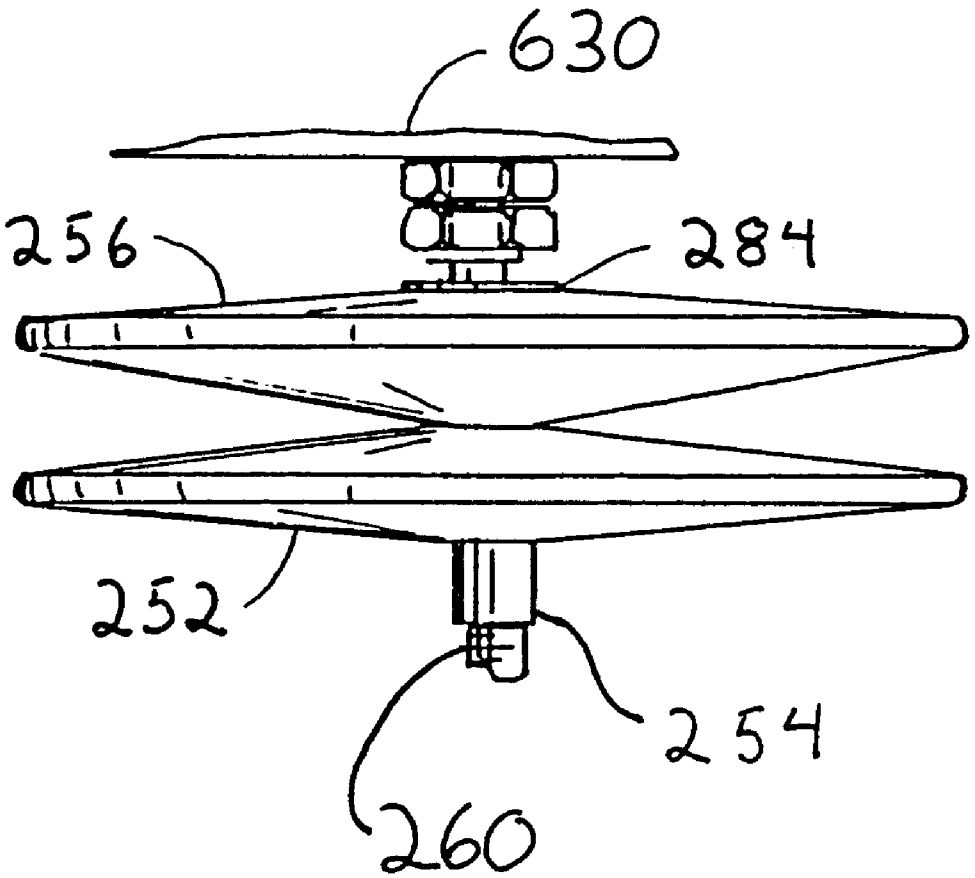
FIG. 7 is a diagrammatic view showing the expanded mode of the bellows.

The bellows 250 contains an ether gas which upon heating expands from a FIG. 6 normal contracted mode to a FIG. 7 expanded mode. Bellows 250 is mounted between lower and upper horizontally extending mounting plates 620 and 630 of bracket 600 by means of an elongated thumb screw 260 extending through an aperture in the lower mounting plate 620. The screw 260 is threadably adjustable relative to the plate 620 and is held in a desired position by locking nut 262. The free end of the screw 260 engages a collar 254 projecting from the lower surface 252 of the bellows 250. Thus, the position of the bellows 250 between bracket plates 620, 630 is adjustable and maintained by manipulation of the thumb screw 260/locking nut 262 combination.

The poppet valve 300 includes a threaded fitting 302 extending through an aperture in the upper mounting plate 630. Lock nuts 304 engage the fitting 302 so as to secure valve 300 to the mounting plate 630. As such the valve stem 280 extends towards the top surface 256 of bellows 250. At this normal position of stem 280 the valve 300 is closed precluding a fluid flow between the inlet and outlet fluid ports as presented by fittings 306, 308.

Figure 3:
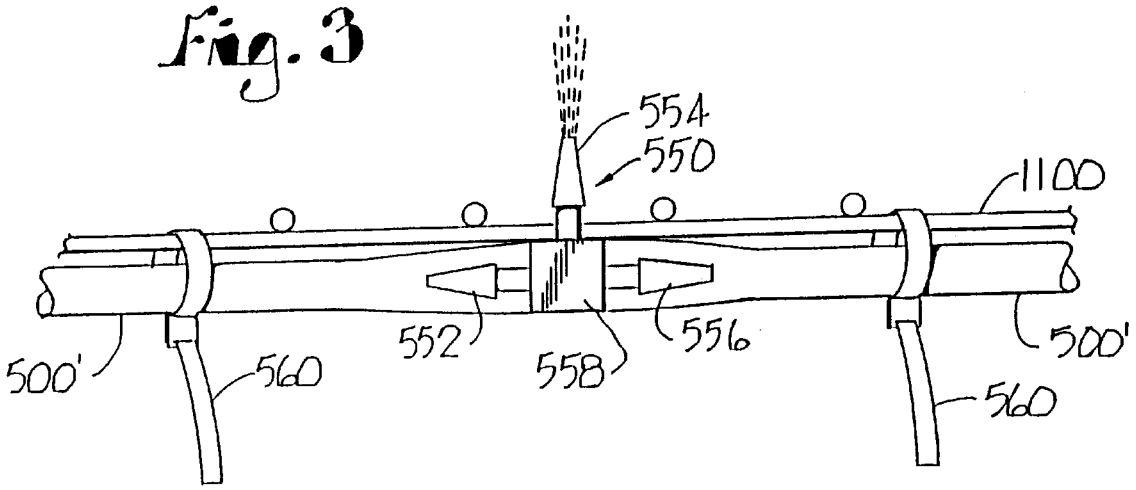
FIG. 3 is a top fragmentary view, on an enlarged scale, of the outlet line attached to the grill and showing the T-shaped fluid connectors joining adjacent segments of the fluid outlet line.
Figure 4:
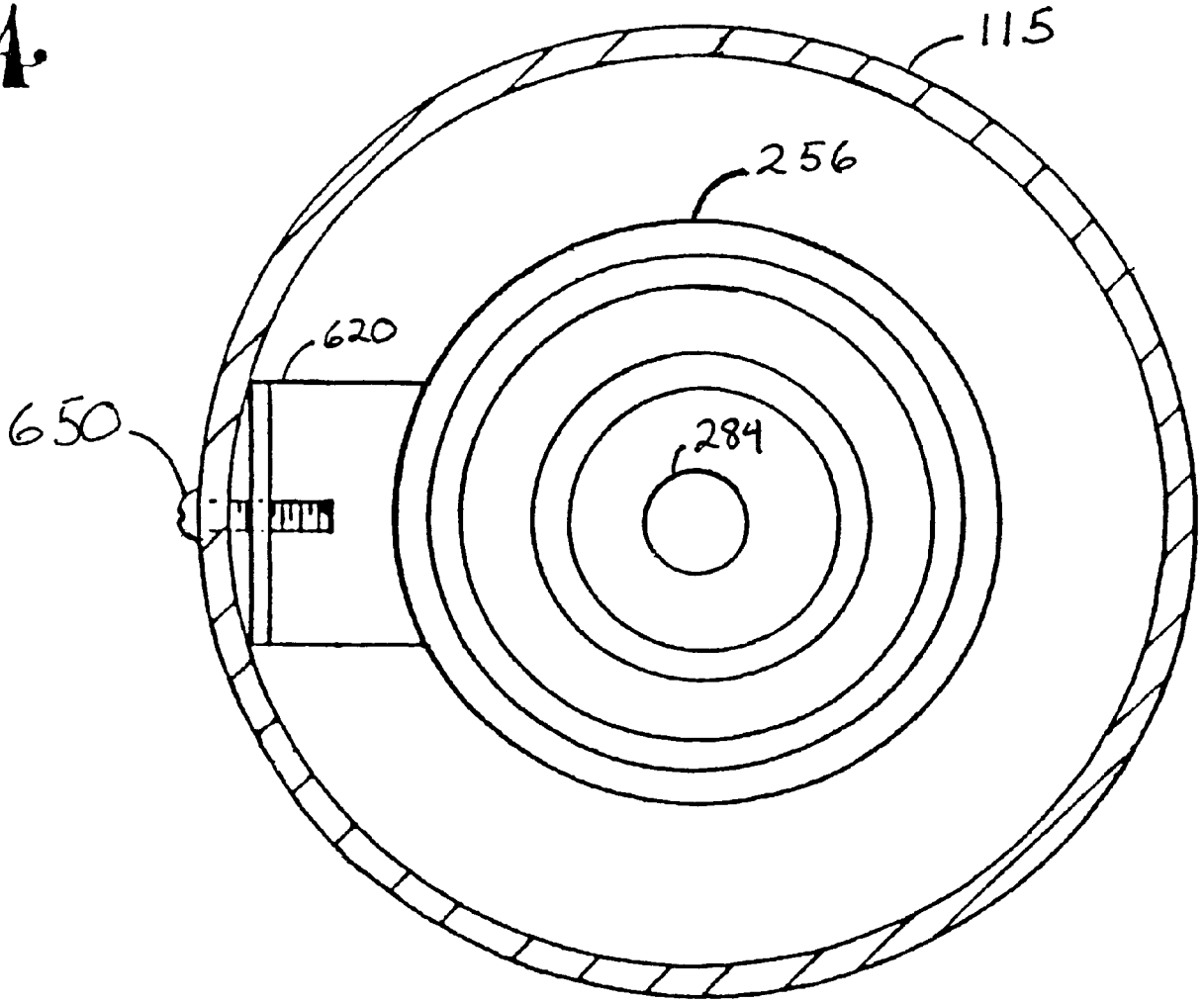
FIG. 4 is a horizontal sectional view taken along line 4—4 in FIG. 5.

Extending through flue wall aperture 502 and attached at one end to the outlet fitting 308 of valve 300 is the elongated outlet line 500 (not shown in FIG. 5). The outlet line 500 includes a plurality of tubular segments 500' connected by intermediate fluid connectors designated as T-heads 550. As best shown in FIG. 3, each T-head 550 includes in-line inlet 552 and outlet 556 nozzles, with an intermediate spray nozzle 554 extending outwardly at a right angle from block 558. The adjacent ends of upstream and downstream outlet line segments 500' are press fitted over the opposed in-line nozzles to encompass the inlet 552 and outlet nozzles 556 therein. A plurality of ties 560 fasten the connected tube segments 500' to the grill 1100 surrounding the condenser unit as shown in FIG. 2. At this position the spray nozzles 554 of each T-head 550 extend through the grill 1100 and towards the encompassed condenser unit. As shown in FIGS. 1 and 2 it is preferred that the outlet line 500 is connected about the entire grill 1100.

Figure 8:
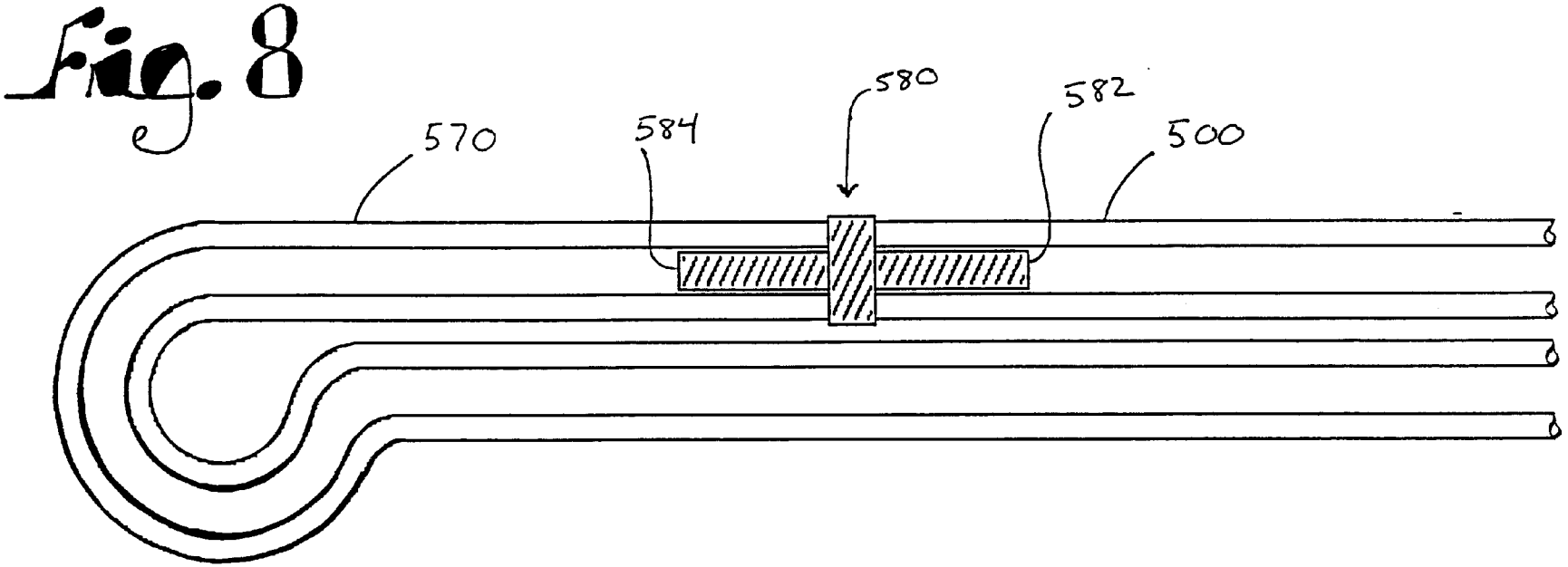
FIG. 8 is a detail view showing the union at the juncture of the return line and outlet line.

A return line 570 communicating with outlet line 500 extends through a flue aperture 503 and discharges water from its end 504 onto bellows 250 (see FIG. 5). Preferably, the return line 570 and outlet line 500 are joined by connecting the outlet line 500 to an inlet nozzle 582 of a tube union 580 and connecting the return line 570 to the outlet nozzle 584 of said tube union 580 (FIG. 8). The tube union 580 may include a flow restrictor presented by a decreased internal diameter as shown in FIG. 8, whereby an increased fluid pressure is created in the outlet line 500 providing an increased fluid pressure at the spray nozzles 554.

In use one end of the inlet line 400 extends through flue aperture 402 and is connected to the inlet fitting 306 with the other end being attached to a water source, e.g. a garden hose connected to the outside water faucet. Upon system operation cooling air is drawn over the condenser unit by fan 1030. The air undergoes a heat exchange with the unit and passes through grill 1050 with a portion of the air being channeled through the flue 100. The ether in the bellows 250 is thermally responsive to a preselected temperature change of this channeled air flow.

The normal or contracted mode of bellows 250 is shown in solid lines in FIGS. 5 and 6. The expanded mode is shown in phantom lines in FIG. 5 and in solid lines in FIG. 7. These modes are achieved by expansion and contraction of the ether gas within bellows 250 as primarily caused by a heat exchange of the internal ether with the air passing through flue 100. Upon the expansion of the bellows 250 towards its FIG. 5 phantom line or FIG. 7 positions, due to an increase in the air temperature, a circular contact plate 284 on upper surface 256 drives the valve stem 280 into the poppet valve 300 so as to urge the valve 300 from a normally closed towards an open position. The plate 284 on surface 256 abuts the fitting 302 at the end of stem 280 travel. Accordingly, during expansion of bellows 250 an increase in stem travel will cause an increase in water flow between the inlet 306 and outlet 308 fittings. The resulting fluid flow through the outlet line 500 flows through the inlet 552 and outlet 556 nozzles of the plurality of T-heads 550. Concurrently, water is also discharged from the spray nozzle 554 of each T-head 550 and onto the condenser unit. Thus, the condenser unit is surrounded by a cooling spray due to the circumscription of the outlet line 500.

Upon cooling of the condenser, a decrease in the temperature of the air flow being passed across the condenser unit 1030 will occur. This temperature decrease is sensed by the ether in bellows 250 so as to return the same towards its contracted FIG. 6 position. This temperature decrease and resulting contraction of the bellows 250 is farther enhanced and hastened by the flow of water from the return line 570 onto the bellows 250. Concurrent with the contraction of the bellows 250, the stem 280 is biased towards its normal position so as to close the valve 300 and cease the flow between the inlet 306 and outlet 308 ports. This reciprocative action of the bellows 250 and valve stem 280 will continue as the temperature of the air flow changes throughout the use of the device.

It should be appreciated that at certain temperatures the water flowed upon the condenser coils will be completely evaporated. At lower temperatures, however, the water may flow past the coils to the ground. In the prior art device disclosed in U.S. Pat. No. 5,311,747, this water could saturate the ground around the condenser unit. In the present invention, the water flowed upon the bellows from the return line causes a positive shutoff of the valve 300, typically after 2 to 3 minutes of the unit delivering water to the coils. The bellows and valve assembly will be reactivated to deliver more water only upon heating of the bellows by passage of sufficiently warm air through the flue from the condenser unit. By pulsing water delivered to the condenser coils in this manner, less water is used overall to cool the coils.

Figure 9:
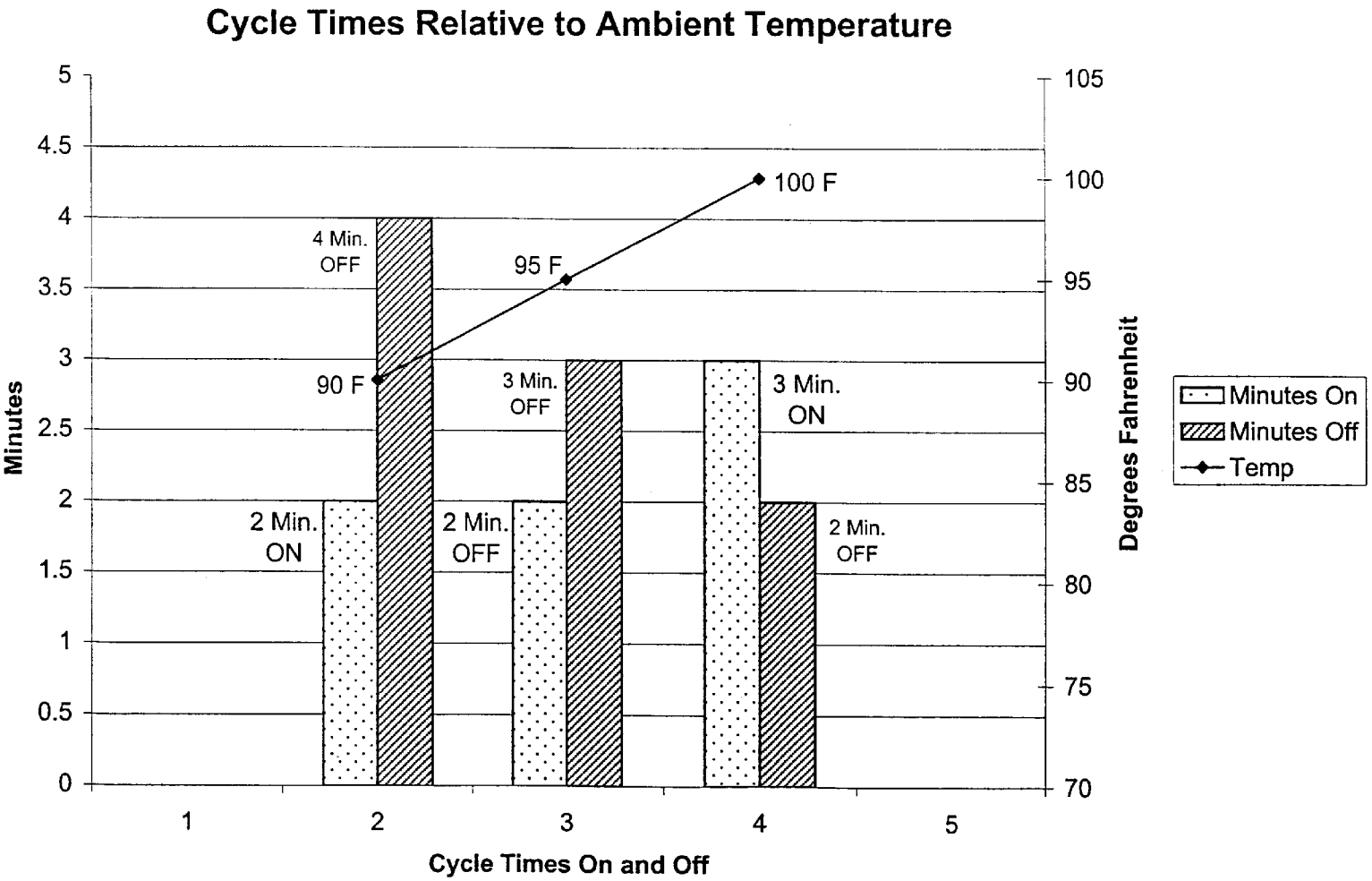
FIG. 9 is a chart graphically illustrating cycle time variation in response to ambient temperature.

The chart labeled "Cycle Times Relative to Ambient Temperature" in FIG. 9 illustrates this operation. When the temperature of the air passing through the flue 100 rises, the cycle time during which the valve 200 is open increases in duration and frequency. For example, at 90° F. the device may cycle on for two minutes and off for four minutes; at 95° F., on for two minutes and off for three minutes; and at 100° F., on for three minutes and off for two minutes. As water is provided to the condenser coils in pulses increasing in duration and/or frequency, the coils are kept wet enhancing the cooling ability of the air conditioner without wasting excess water.

Although one form of this invention has been illustrated and described herein, the invention is not limited thereto except as set forth in the following claims and allowable equivalents thereof.

Having thus described the invention what is claimed as new and desired to be secured by Letters Patent is as follows:

1. A fluid cooling apparatus for a condenser unit or the like comprising in combination:

a flue;

means for mounting said flue in a position adjacent the condenser unit for channeling a portion of an air flow passing over the condenser unit therethrough;

a valve assembly having an open and a closed condition for regulating the flow of a fluid between a fluid inlet and a fluid outlet, said valve assembly including a structure responsive to the ambient temperature in the flue;

means for mounting said valve assembly within said flue;

an elongated fluid outlet line connected to said fluid outlet;

means for mounting said fluid outlet line about said condenser unit;

means for discharging a portion of said fluid in said outlet line onto the condenser unit;

and means for returning a remaining portion of fluid from said outlet line to said flue and onto said temperature responsive structure to repeatedly cycle the valve assembly between said open and closed conditions.

2. The apparatus of claim 1, wherein said means for returning fluid is an extension of said outlet line.

3. The apparatus of claim 1, wherein said means for discharging is a plurality of nozzles.

4. The apparatus of claim 3, further comprising means associated with said returning means for restricting return flow to create an increased fluid pressure in said outlet line and thereby provide increased fluid pressure at said nozzles.

5. The apparatus of claim 1, wherein said means for returning fluid is a return line connected to said outlet line.

6. The apparatus of claim 5, furher comprising a tube union connecting said return line to said outlet line.

7. The apparatus of claim 6, wherein said tube union includes a flow restrictor for creating an increased fluid pressure in said outlet line.

8. The apparatus of claim 5, further comprising a flow restrictor in said return line for increasing fluid pressure in said outlet line.

* * * * *